United States Patent [19]

Hultgren et al.

[11] 4,157,678

[45] Jun. 12, 1979

[54] RAMMER DEVICE

[75] Inventors: K. Sten R. Hultgren; J. P. Göran Sundmar, both of Karlskoga, Sweden

[73] Assignee: AB Bofors, Bofors, Sweden

[21] Appl. No.: 778,287

[22] Filed: Mar. 16, 1977

[30] Foreign Application Priority Data

Mar. 31, 1976 [SE] Sweden ..... 7603849

[51] Int. Cl.[2] ..... F41F 17/16

[52] U.S. Cl. ..... 89/47

[58] Field of Search ..... 89/45, 46, 47, 33 A, 89/33 B

[56] References Cited

FOREIGN PATENT DOCUMENTS 9045 of 1907 United Kingdom ..... 89/47

15035 of 1910 United Kingdom ..... 89/47

262858 12/1926 United Kingdom ..... 89/47

*Primary Examiner*—Stephen C. Bentley

*Attorney, Agent, or Firm*—Pollock, Vande Sande & Priddy

[57] ABSTRACT

A rammer head assembly for moving a projectile and a propellant charge from a first position behind a barrel chamber of a firearm into a second position within the barrel chamber, with the propellant charge being positioned adjacent to a closed rear end of the chamber. The rammer head assembly being rotatably supported so as to swing the propellant charge end-to-end behind the projectile and including a pivotable front end portion for contacting and moving the projectile into the firing chamber.

9 Claims, 11 Drawing Figures

RAMMER DEVICE

BACKGROUND OF THE INVENTION

The present invention relates to a firearm related device for actuating a shell (or the like) by means of a rammer head, from a first position on a loading tray which is swung in to coincide with the extension of the axis of the bore of the barrel, towards a second or firing position within the barrel chamber.

The invention is primarily intended for use for firearms in which a shell is positioned together with a bag containing a propellant charge in the chamber position. Further, it is intended for firearms in which the ramming of the shell and the application of the propellant charge is automatized.

In general, during ramming of the shell itself, at least when the barrel is new or has been used very little, there is a risk that the shell, due to the application of the ramming force, will become lodged obliquely at the lands of the rifling, causing the shell to become jammed. During automatized ramming procedures with high ramming speeds and/or great ramming forces, this problem is accentuated to a still higher degree.

OBJECTS OF THE PRESENT INVENTION

One of the objects of the invention is to create a device which solves the jamming problem, and a novel feature that is disclosed in the present invention is that the rammer head is arranged so that it can be swung in towards the shell in the transversal direction of this and that the rammer head carries a front part arranged so that this can be turned up and down, and by means of which the rammer head can coact with the shell.

In a further development of the concept of the invention, a specific embodiment is disclosed which comprises a retardation of the propellant charge so that it is prevented from striking the rear surface of the shell with too great a force, unnecessarily deforming the propellant charge.

BRIEF DESCRIPTION OF THE DRAWINGS

An embodiment proposed at present of a device which has the characteristics significant for the invention will be described in the following, with reference to the accompanying drawings, in which.

DESCRIPTION OF A PREFERRED EMBODIMENT

Figure 1:
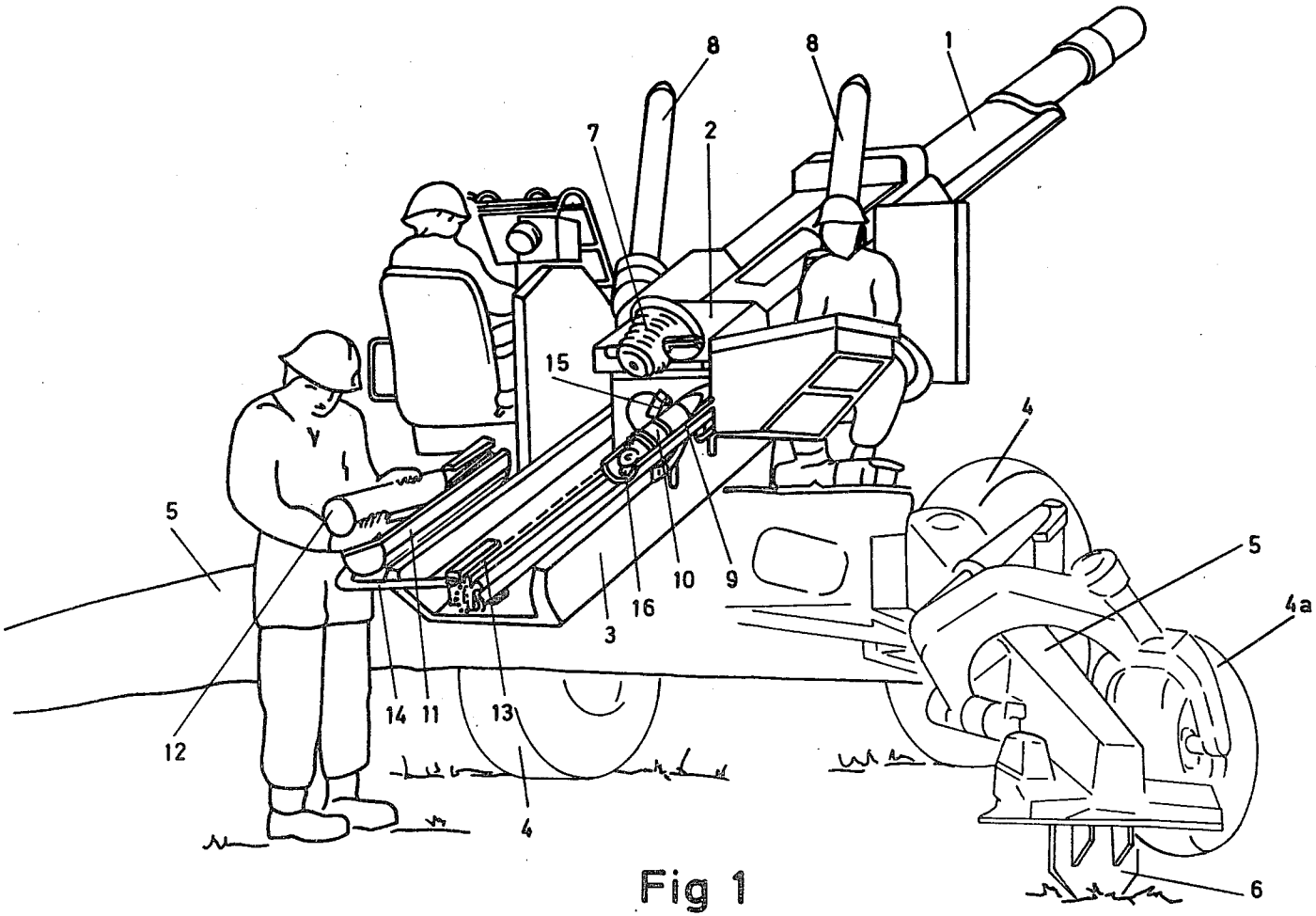
FIG. 1 shows in perspective and obliquely from the rear to the right a field-artillery weapon in which the invention is used.

FIG. 1 shows a field-artillery weapon which is in itself known, the barrel of which is designated 1 and the breech ring designated 2. The known firearm is positioned on an upper carriage so that it can be traversed in relation to a lower carriage. Further, the firearm is provided with a cradle 3, in which the barrel 1 slides on guide rules when it carries out its recoil movement. The weapon runs on wheels, and is provided with a pair of driving wheels 4. A pair of carriage trails 5 include pivot wheels designated 4*a* which can be raised and lowered, and which pivot freely in the lowered position. In FIG. 1, carriage trails 5 are spread, and fixed to the ground via trail spades 6 when the weapon is in the firing position. At the rear portion of the breech ring 2, a closing unit is arranged, which in the preferred embodiment may consist of a screw mechanism 7 with a cover and a chamber screw supported thereon, which are conventional. For the opening and closing of the breech mechanism, a so-called semi-automatic device is used, of a kind which is also known. The elements controlling and supporting the elevation of the barrel are designated at 8.

At the rear parts of the cradle 3 of the firearm, loading devices are arranged to provide a rapid and automatic loading procedure. The loading members comprise a loading tray 9 for receiving a projectile or shell 10, with the transfer of the projectile or shell 10 to the loading tray 9 taking place in a way which is known in itself. The loading tray 9 is locked to the elevating mass and can be swung in and out laterally in relation to the longitudinal direction of the firearm, which swinging in and out takes place in the plane of the loading tray 9. In the position shown in FIG. 1, the loading tray 9 receives the projectile, and in the swung-in position the axis of rotation of the projectile substantially coincides with the extension of the axis of the bore of the barrel 1, which is not shown. The loading members also comprise a carrying part 11 for a propellant charge 12, which comprises a bag which may be made of cloth or the like, filled with powder, with a cylindrical form. The carrying part for the propellant charge 12 is in itself formed from a rammer head on a rammer car 13 of a type which is known in itself, the running movement of which is geared to achieve the high speed during the loading procedure. The rammer and combined carrying part comprises a cradle-formed unit and an arm 14, which includes one end rigidly fastened to the cradle-formed unit and another end rotatably supported in the rammer car 13, so that the cradle-formed unit will be rotatable laterally along an arc-shaped line between the first position shown in FIG. 1, which is the receiving position for the propellant charge, and a second position in the extension of the axis of the bore. The rammer car 13 can be run inside the cradle 3 in the logitudinal direction of the firearm between the end position shown in FIG. 1 and an advanced position in which the propellant charge 12 is inserted in the firing chamber of the barrel 1 behind the projectile 10. The arrangement shown, reduces the risk of the firearm being impeded in its recoiling, and a limited extent of the loading members concerned in the longitudinal direction of the firearm is obtained, resulting in high angles of elevation (for instance up to 70°) for the barrel 1.

At the breech ring, a charge retainer 15 for the propellant charge 12 is also arranged. The charge retainer 15 is spring actuated and gives way when the projectile 10 and propellant charge 12 are inserted in the chamber of the barrel 1, with its purpose being to ensure that the propellant charge 12 obtains the correct longitudinal position in the barrel 1 when the combination rammer and carrying part is retracted from the barrel. The loading tray 9 is made with a spring-action stop 16, which prevents the projectile 10 from sliding off the loading tray 9 when the firearm is in high angles of elevation.

Figure 2:
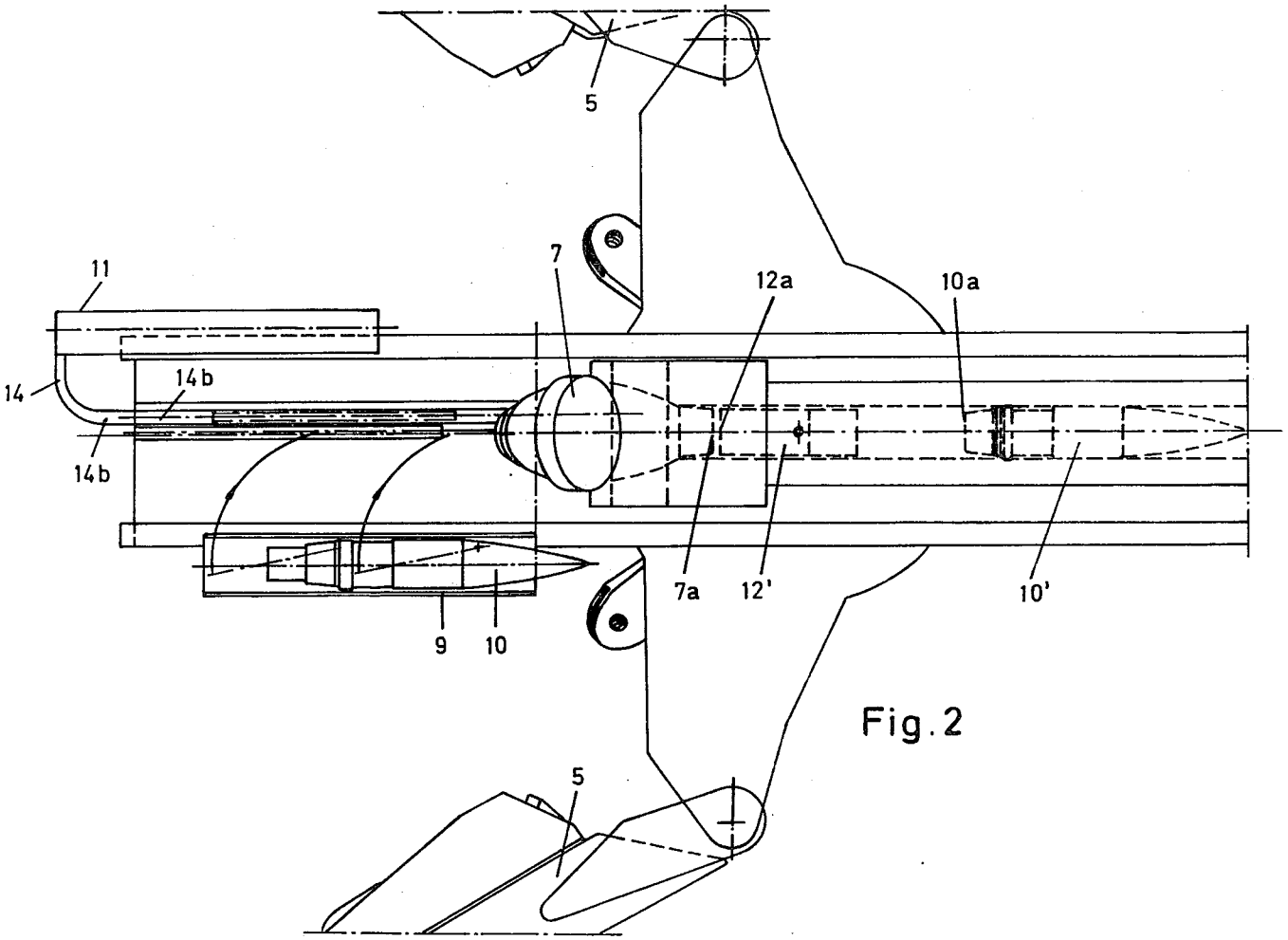
FIG. 2 shows in a horizontal view parts of the weapon according to the embodiment of FIG. 1.
Figure 3:
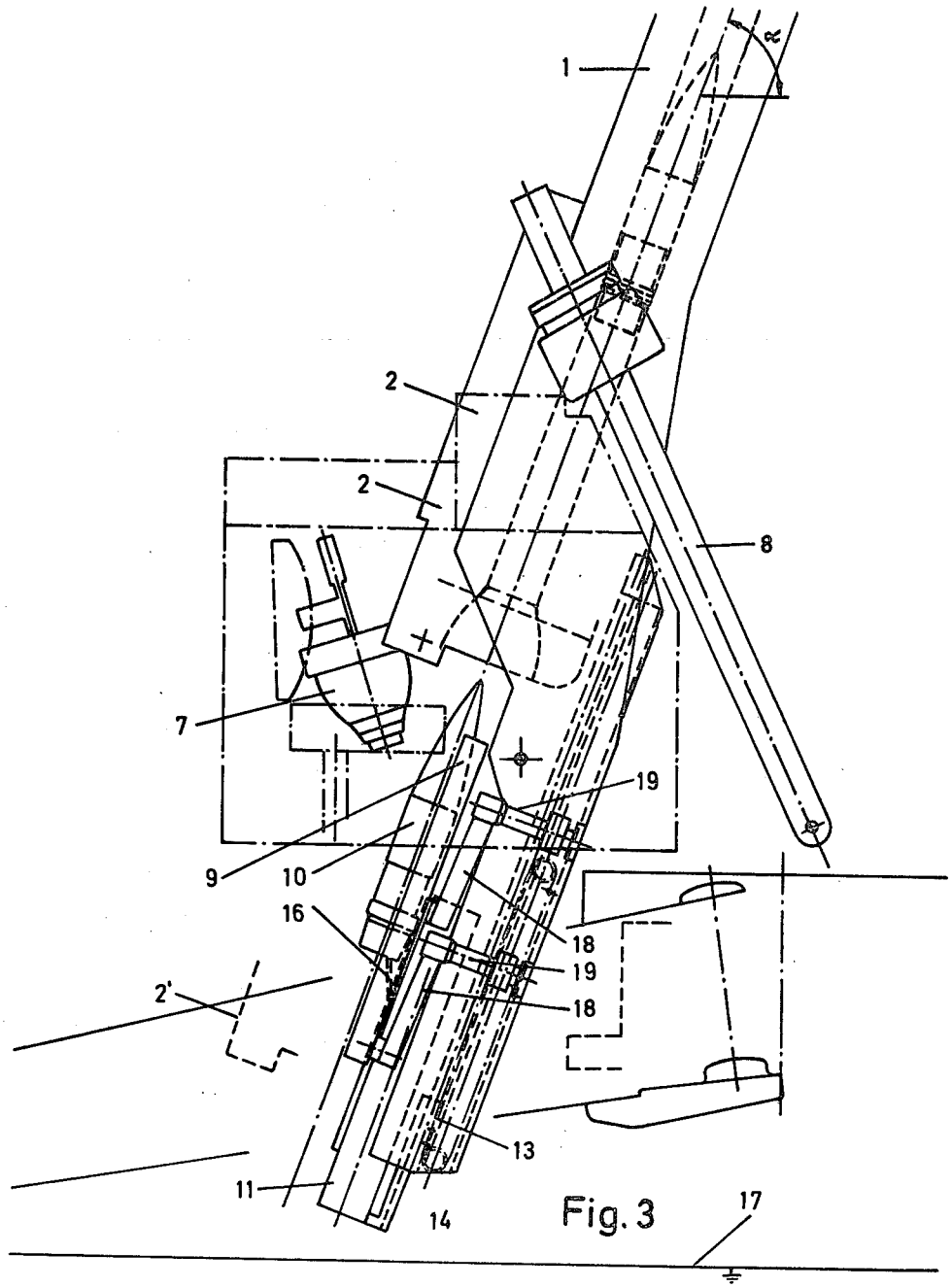
FIG. 3 shows in a side view parts of the weapon according to FIG. 1, at the maximum angle of elevation.

In FIG. 2, arrows show the swinging-in movement of the loading tray 9 from the side position or the receiving position to the position coinciding with the axis of the bore. Likewise, the position of the projectile in the bore of the barrel or the origin of the rifling is indicated, and is designated 10'. In a corresponding way, the chamber position of the propellant charge is designated 12'. The propellant charge can have various lengths, as is indicated in the FIG. 2, and except when it has the maximum length, it does not fill up the entire space between an obturating surface 7*a* (shown with dash lines in the position it assumes when the screw mechanism is closed) of the screw mechanism 7 and the rear surface 10*a* of the shell. It is then essential that in the latter case the propellant charge is placed in the chamber so that one of its end surfaces 12*a* comes close to or against the surface 7*a* of the screw mechanism. Otherwise, an unacceptable dispersion of the shells is obtained. FIG. 3 is intended to show parts of the preferred embodiment described above when the firearm is in the maximum angle of elevation $\alpha=70°$. The fully rcoiled position of the firearm is designated 2', from which it will be noted that it is necessary that the combination rammer and carrying part and the loading tray can be swung aside. The ground surface is designated 17.

Figure 4:
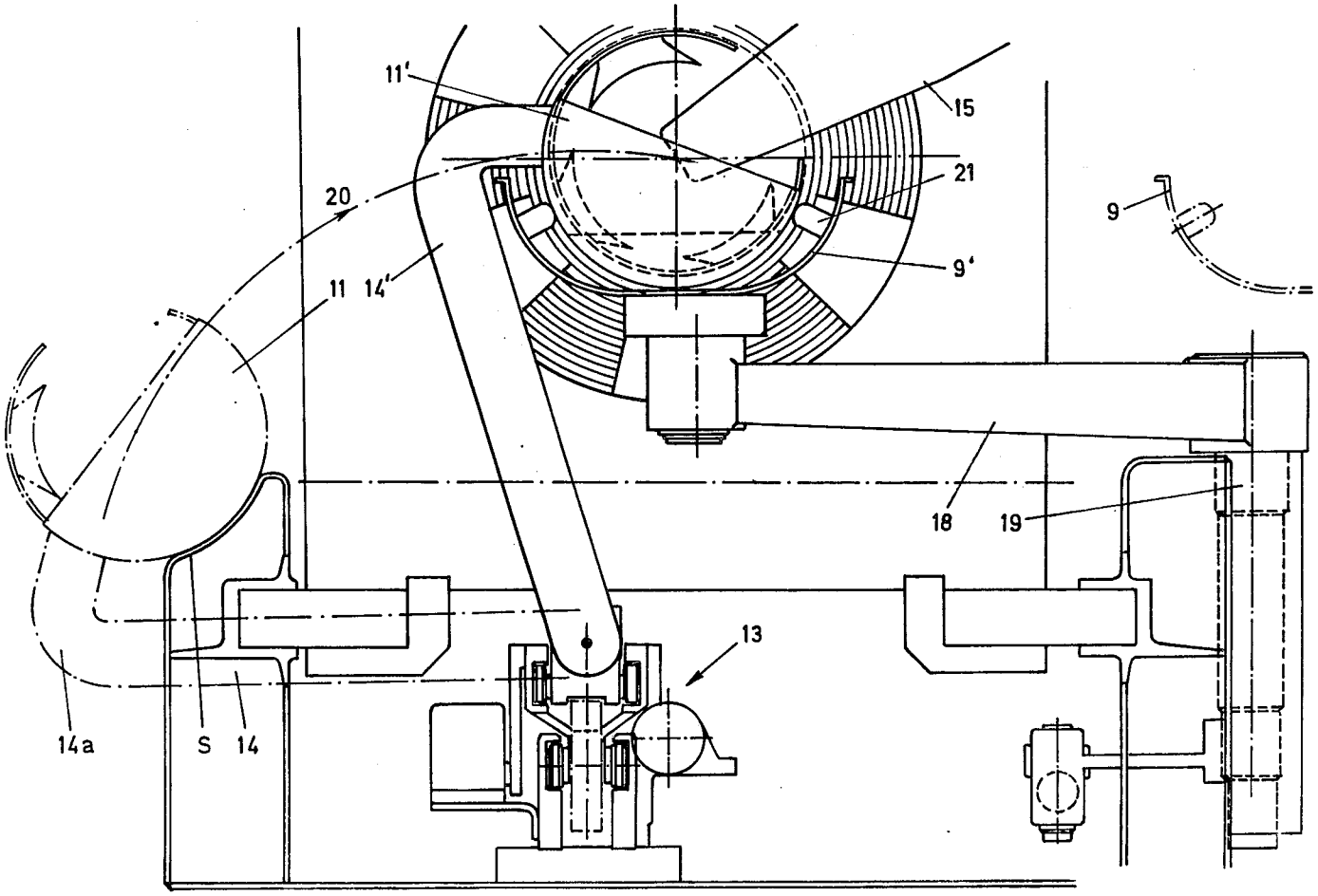
FIG. 4 shows in an end view from the rear, members of the weapon according to FIG. 1 engaged in the loading procedure.

FIG. 4 shows the preferred embodiment, wherein the loading tray 9 is swung in into its second position 9'. The loading tray 9 is supported in a known way on two parallel arms 18, of which only one is shown in FIG. 4, while both arms are shown in FIG. 3. The arms 18 are rotatably attached to the loading tray 9, at the under side thereof, and also to fixed supports 19, so that the loading tray 9 can be displaced in a parallel manner to the lateral direction by swinging in its own plane. In FIG. 4, the cradle-formed unit 11 and the arm 14 are moved to their positions 11' and 14' in the extension of the axis of the bore with the unit 11 being moved along an arc-shaped line 20. When the unit 11 is swung in, the front parts of this will be moved down into the loading tray 9, at the rear parts of this (see also FIG. 2). When the unit 11 is moved down, it will come into contact with guide rails 21, extending internally in the longitudinal direction of the loading tray. When the unit 11 is moved down into the loading tray 9, the propellant charge 12 inserted in the unit 11 will come into a position behind the projectile 10 applied in the loading tray 9. The arm 14, which is rigidly fastened in the unit 11, is made with an angular fastening part 14*a* at the unit 11, permitting the arm, at the connection together of the unit 11 and the loading tray 9, to extend over one side edge of the latter, which can thereby be given the same height as the other side edge of the loading tray. The rotatable fastening in the rammer car 13 is achieved by means of an angular part 14*b* of the arm 14.

The unit 11 has the form of a circular tube which has been cut in half along its longitudinal direction, with a rear end wall. In the position designated 11 in FIG. 4, the opening of the unit is turned somewhat towards the person who is inserting a propellant charge 12, while in the position designated 11' the opening is turned somewhat away from the same person. The outside of the unit 11 coacts with a supporting part S which has been given a shape corresponding to the section in question of the outside of the unit 11. In this way, the combination rammer and carrying part assumes a defined side or load position. The charge retainer 15 is arranged in connection with the opening of the unit in the second position 11'.

In the position thus connected together according to FIG. 4, the unit 11 is intended to be displaced in relation to the loading tray 9 inside of this, and in its longitudinal direction, on the guide rails 21, i.e., at right angles to the plane of the FIG. 4. The displacement of the unit takes place by means of the rammer car 13 via the arm 14. During its movement forwards, the unit 11 actuates the projectile 10 in the loading tray 9, and moves the projectile 10 in front of itself so that the projectile slides off the loading tray and into its position in the bore of the barrel, at the same time as the propellant charge 12 remaining in the unit 11 comes into a position behind the projectile in the chamber of the barrel, as shown in FIG. 3. The guiding of the rammer car 13 can take place in a way which is known in itself, and the swinging in and out of the combination rammer and carrying part and the loading tray can be carried out in a way which is known in itself.

The ramming speed can be made comparatively high, for example approx. 4 m/s, and therefore the unit 11 stops before the projectile 10 has reached its end position in the bore of the barrel 1. From the stopping position, the projectile 10 will continue to move via free flight with kinetic energy obtained from the movement of unit 11 until it reaches its end position.

Figure 5:
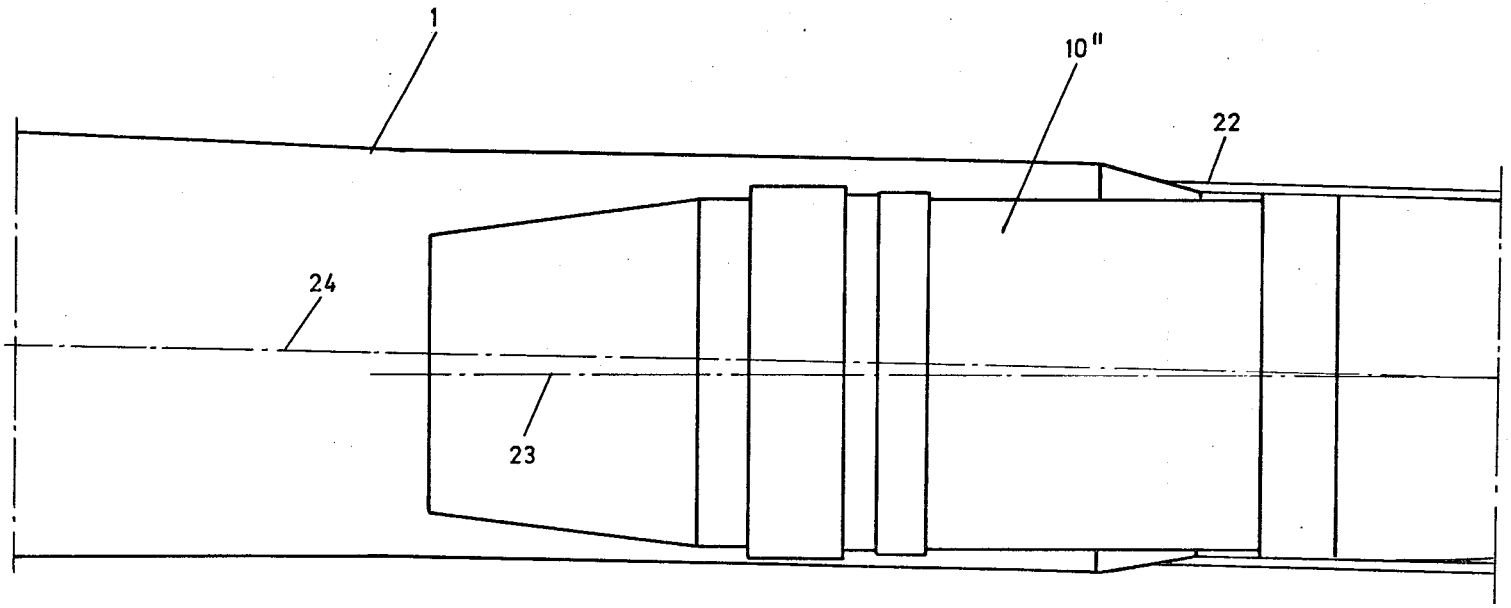
FIG. 5 shows in a longitudinal section a shell positioned in the origin of the rifling portion in the barrel.

During the ramming procedure for the shell 10, it is of importance that the shell does not become lodged obliquely at the origin of the barrel chamber 22, as is illustrated with a round 10" in FIG. 5. The oblique position results the axis of rotation 23 of the shell diverging from the axis of the bore 24, and creates a substantial risk, particularly in the case of unused barrels, that the shell will become jammed within the barrel. The oblique position is caused by incorrect ramming, which is corrected with the device according to the invention.

Figure 6:
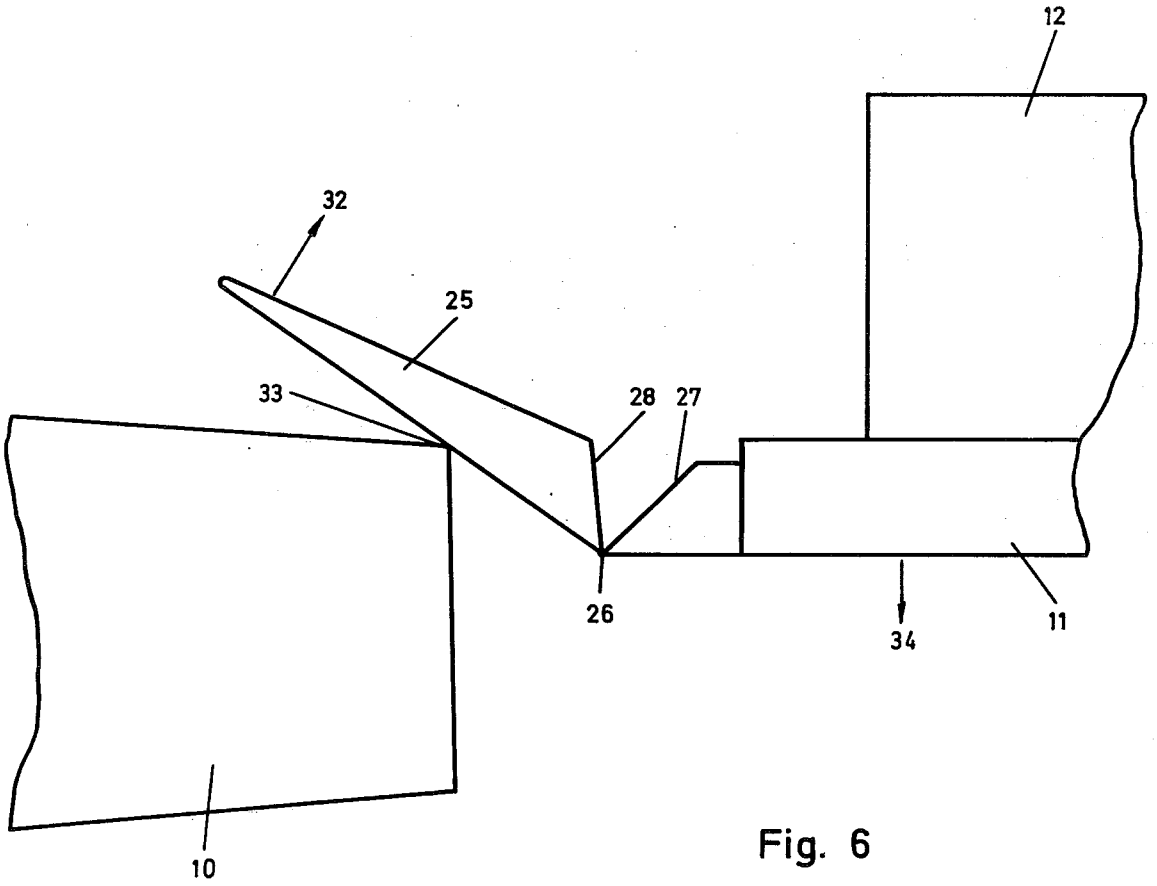
FIG. 6 shows in principle a first functioning stage of a loading procedure.
Figure 7:
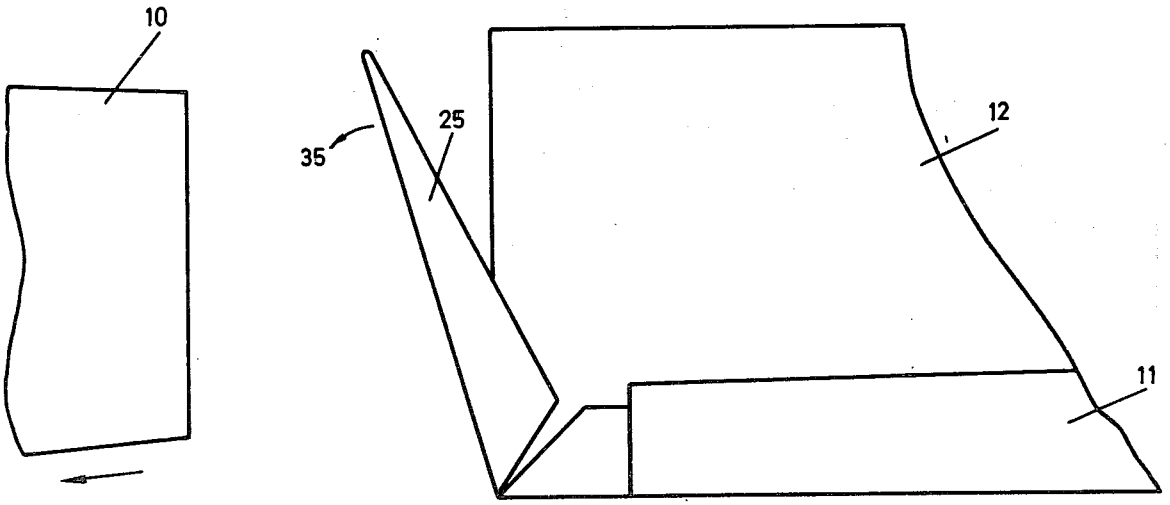
FIG. 7 shows in principle a second functioning stage of the loading procedure.
Figure 8:
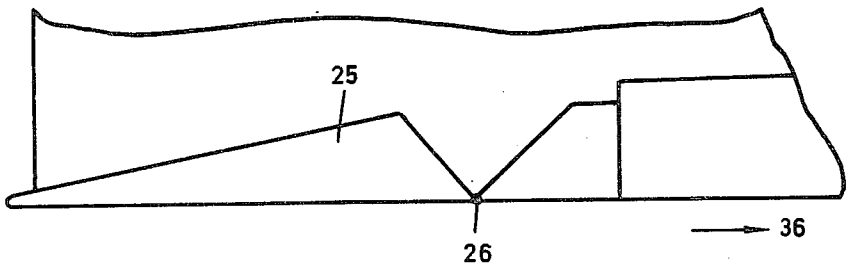
FIG. 8 shows in principle a third stage in the loading procedure.

The ramming unit, which for the sake of clearness is not shown in FIGS. 1 and 2, but is shown in FIGS. 6–9*c*, is provided with a front part 25, which is arranged in a support 26, so that it can be turned up and down. The turned-up position which is shown in FIG. 9*a* is defined when obliquely set side edges 27 and 28 (see, e.g. FIG. 6) are positioned proximate to one another. The turned-down position, which is shown in FIG. 8, is achieved in a way which is known in itself by means of stops or the like of a conventional kind. The actual support comprises a shaft 29, indicated in FIGS. 9*a*–9*c*, which extends at right angles to the longitudinal direction of the unit 11. The front part 25 is supported in a fastening part 30 which, in turn, is fastened in the front part of the unit 11 with screws, rivets, etc., indicated by the numeral 31. In its turned-down position, the front part 25 conforms internally to the rounded form of the unit, so that, in principle, the inner surface of the front part constitutes an extension of the rest of the inner surface of the unit 11. As shown in FIG. 9*b*, the front part 25 has a tapered form towards its free end, and the front part also has a length which exceeds the diameter of the rear surface 10*a* of the shell. As the front part 25, in its turned-up position, will have a convex surface 25a facing the rear surface of the shell, the coaction between the front part 25 and the rear surface 10a will take place via a line or a very small surface element extending substantially diametrically over the rear surface.

Figure 9A:
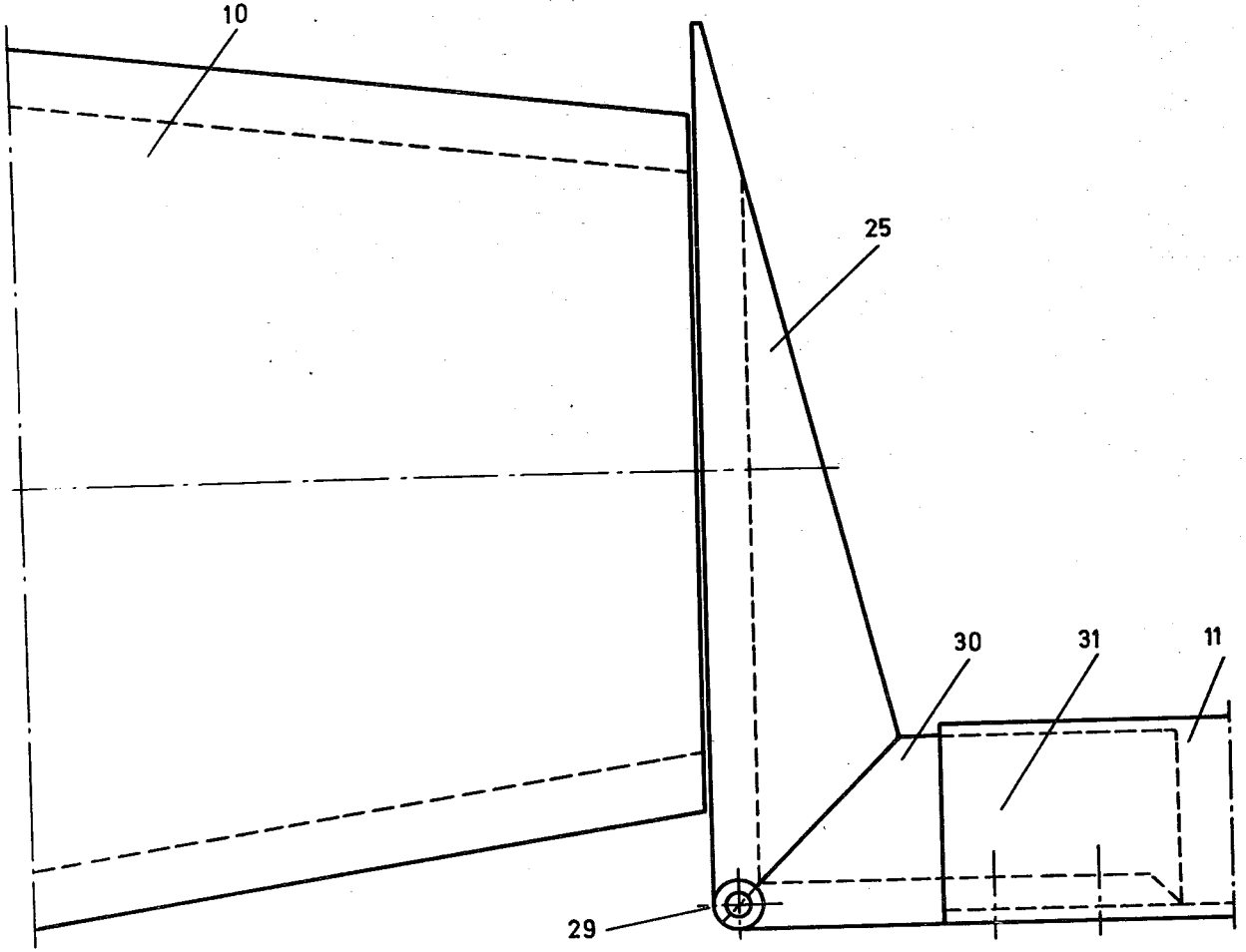
FIGS. 9*a*–9*c* show in various views the design of a part included in the loading members.
Figure 9B:
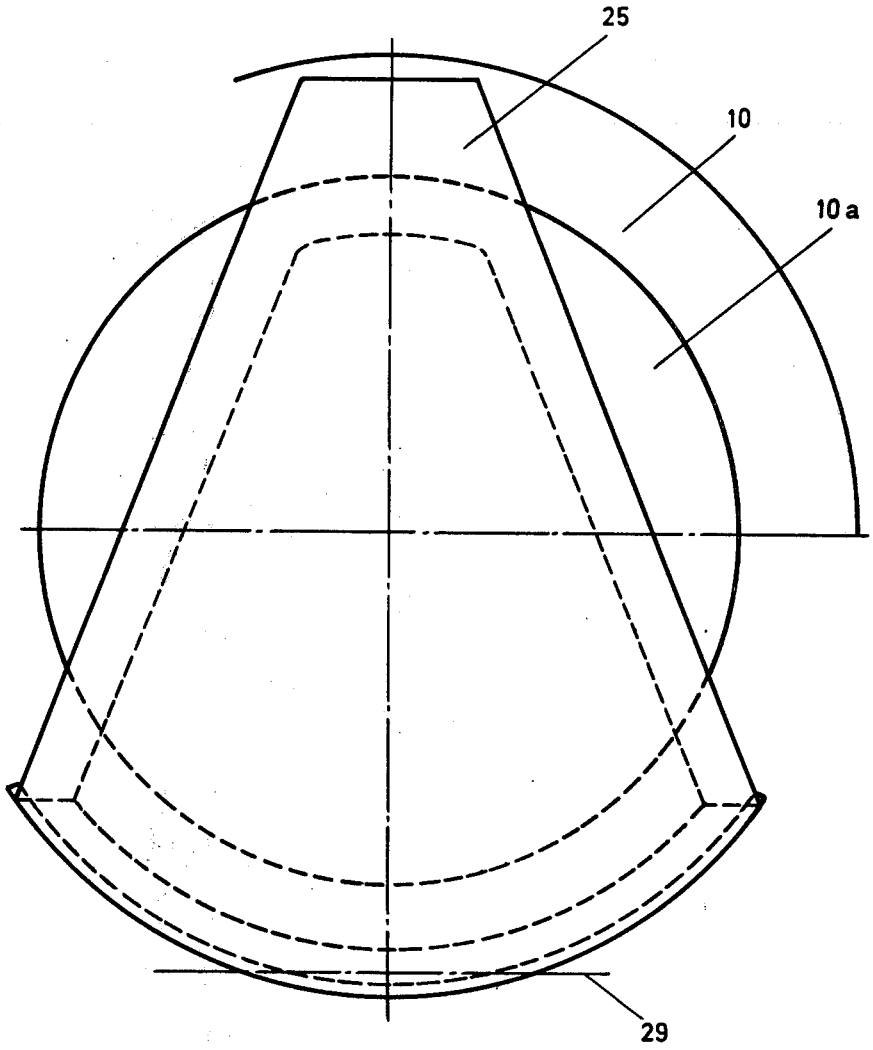
Figure 9C:
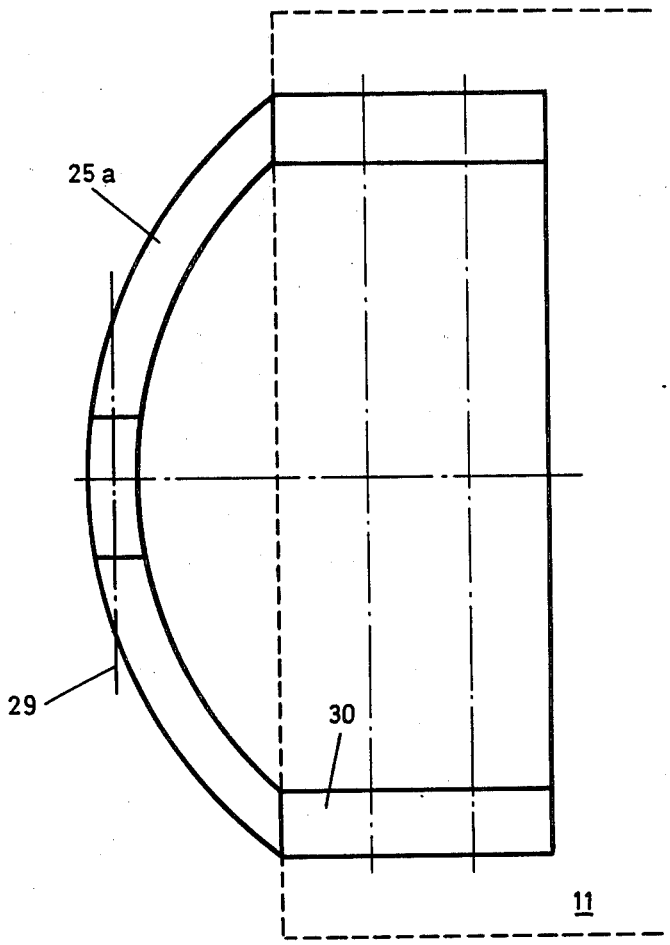

FIG. 6 is intended to illustrate the unit 11 in the loading procedure is located just ahead of its position according to FIG. 4. As the front part 25, in the side position of the unit according to FIG. 4 has been assumed to have the turned-down position, the loading tray 9 and the unit 11 are arranged in relation to each other so that the front part 25, just before the unit is moved down into the loading tray 9 in accordance with FIG. 6, comes into contact with the shell 10, and is thereby turned upwards as indicated by the arrow 32. In the initial stage, the front part coacts with a side surface of the skirt of the shell, and in the position according to FIG. 6 it goes over into contact with the rear surface 33. Through this coaction, the front part 25 is forced up towards its turned-up position, as the unit is moved down into the loading tray 9 in the direction indicated by the arrow 34. When the unit 11 is thereafter actuated forwards towards the barrel by the rammer car 13, the front part 25 comes into contact with the rear surface of the shell as shown in FIG. 9a.

When the unit 11 with the propellant charge 12 placed on it has reached the position illustrated in FIG. 7 in the chamber position, as mentioned above, the shell 10 will continue in free flight towards the origin of the rifling. The kinetic energy in both the front part 25 and in the propellant charge 12 throws the front part forwards in the direction shown by the arrow 35. The front part can then be adapted so that it serves as a retardation member for the propellant charge, so that this does not continue forwards with too great a force when the front part 25 assumes the turned-down position according to FIG. 8, and strikes the rear surface of the shell so that it will be unnecessarily deformed. In addition to the propellant charge being braked by the front part 25, it can also be braked by special springs, not shown, in the unit 11, which springs squeeze the propellant charge but are arranged so that they can also yield.

When the front part 25 is thus turned down, the unit 11 and the propellant charge are displaced in relation to each other. This relative displacement is achieved in that the propellant charge, at its rear end, can coact with the above-mentioned charge retainer 15 when the unit 11 is given a retracting movement from the chamber position by the rammer car towards 36 in FIG. 8.

The charge retainer 15 ensures that the propellant charge 12 assumes a defined and uniform longitudinal displacement position in the chamber, which longitudinal position has been determined so that the closing mechanism, when being closed, can finally adjust the longitudinal displacement further, with the propellant charge remaining in contact with the surface 7a of the closing mechanism. This requires the closing mechanism to work with a gentle closing movement, at least in the final stage. It is previously known to have closing mechanisms work with such gentle closing movements.

The rammer car 13 continues to its end position, where the unit 11 is moved to the side, so that it will not impede the firearm during recoils. When the unit 11 has reached the end position, the loading tray 9 can also be moved to the side. When the unit 11 is moved away, the front part 25 remains in its turned-down position until next time the unit is moved into contact with the loading tray, when the front part coacts with a new shell in the loading tray, etc.

The charge retainer 15 is of a design which is known in itself, and gives way for the shell and the propellant charge when these are moved into the chamber by the combination rammer and carrying part. The charge retainer 15 also gives way in a way which is known in itself at the closing of the screw mechanism 7, when it comes in between the closing parts in question. The charge retainer 15 is arranged in one of the sections of the mechanism in which there are no threads. In its turned-out position, the charge retainer withstands forces directed from the inside of the barrel and outwards, so that it permits the propellant charge to be removed from the unit 11. The charge retainer 15 can have the form of a flat spring suspended in a hinge with a built-in stop which defines the turned-out position of the charge retainer. In the turned-in position, the charge retainer also coacts with a moving-out spring in the closing mechanism.

The length of the unit 11 is adapted to the length of the chamber position and the possibility of ramming the projectile or shell 10 with said free flight inside the chamber position so that good ramming will be obtained in the origin of the rifling even at high elevations. In this connection, and also generally, in order to increase the uniformity of the ramming, within a distance of approx. 300 mm nearest the origin of the rifling, the barrel has been made cylindrical, with the smallest possible diameter.

In a further embodiment, a spring is arranged at the supporting axle 29 which strives to move the front part 25 towards its turned-up position.

In its turned-up position according to FIG. 9a, the front part 25 engages the rear surface at an angle which involves that the shell, in addition to its longitudinal displacement movement is also given a tipping movement which involves that the axis of rotation of the shell (cf. FIG. 5) coincides with or will be parallel to the axis of the bore or its extension. In the case according to FIG. 9a, the angle is substantially at right angles to the axis of the bore, but can be varied in dependence on the ramming speed and the shape and weight of the shell.

The invention is not limited to the embodiment shown above as an example, but can be subject to modifications within the scope of the following claims.

We claim:

1. A ram assembly for properly positioning both a projectile and its propellant charge within a chamber of a firearm having a rifled barrel, comprising:

a rammer head assembly pivotally attached to said firearm and having a curved shape to support said propellant charge;

said rammer head assembly being pivotable into an aligned position proximate to a rear end of a projectile aligned with said chamber;

drive means for moving said rammer head assembly and said propellant charge toward said chamber; and cover means pivotally attached to said rammer head for driving said projectile into said chamber and for retarding the motion of said propellant charge to reduce the force with which said charge contacts said projectile in said chamber.

2. A ram assembly according to claim 1, wherein said head assembly includes an open slot portion for introducing said propellant charge therethrough.

3. A ram assembly according to claim 1, wherein said projectile is supported within a loading tray which is attached to said firearm for pivotal motion from a load position to a position directly behind said chamber.

4. A ram assembly according to claim 1, wherein said drive means comprises a ram cart attached to said rammer head and movable along a track of said firearm extending a parallel direction to an axis extending through said barrel;

wherein movement of said cart during loading forces said rammer head assembly to move toward said chamber.

5. A ram assembly according to claim 1, wherein said cover means comprises a plate member pivotally attached to a body portion of said rammer head and extendible between said projectile and said propellant charge to drive said projectile into said chamber when activated by movement of said drive means, with said plate member contacting and retarding movement of said propellant charge.

6. A ram assembly according to claim 5, wherein said plate member strikes a side portion of said projectile and is pivoted to a position between said projectile and said propellant charge.

7. A ram assembly according to claim 5, wherein a charge retainer is attached to said barrel and extends into a passageway entering said chamber to block said propellant charge from exiting from said chamber;

wherein said plate member is pivoted to an open position by said propellant chage passing thereover.

8. A ram assembly according to claim 5 wherein said plate member has a rounded cross-section conforming in shape to said rammer head assembly, and said plate member extends beyond a diameter of said rear end of said projectile, wherein a convex portion of said plate member contacts said rear surface of said projectile at two diametrically opposite points which generates a slight tipping motion in said projectile during contact.

9. A ram assembly according to claim 5, wherein a spring assembly is attached to said rammer head assembly to pivot said plate member between said projectile and said propellant charge.

* * * * *